United States Patent [19]

Iio et al.

[11] Patent Number: 4,786,771

[45] Date of Patent: Nov. 22, 1988

[54] CIRCUIT INTERRUPTER WITH TWO STAGE STOPPER PREVENTING BOUNCE BACK

[75] Inventors: Tsukasa Iio; Yoshinori Mochizuki; Hiroshi Fujii; Yasusi Genba; Hideaki Moriwaki, all of Midori, Japan

[73] Assignee: Mitsubishi Denki Kabushiki Kaisha, Japan

[21] Appl. No.: 95,463

[22] Filed: Sep. 4, 1987

[30] Foreign Application Priority Data

Sep. 9, 1986 [JP] Japan ..... 61-138776[U]

[51] Int. Cl.[4] ..... H01H 3/46

[52] U.S. Cl. ..... 200/153 G; 200/288

[58] Field of Search ..... 200/288, 153 G

[56] References Cited

U.S. PATENT DOCUMENTS 3,805,199 4/1974 Tazuki ..... 200/153 G

FOREIGN PATENT DOCUMENTS 52-11569 1/1977 Japan .

1523407 8/1978 United Kingdom ..... 200/153 G

*Primary Examiner*—Renee S. Luebke

*Attorney, Agent, or Firm*—Leydig, Voit & Mayer

[57] ABSTRACT

A circuit interrupter comprises a toggle link having an upper toggle link and a lower toggle link pivotally connected by a knee pin to each other, a movable contact arm having a movable contact element secured thereon and connected to the lower toggle link of the toggle link, and a toggle link stopper capable of contacting the upper toggle link for preventing the bouncing back of the movable contact arm during tripping of the movable contact arm. The toggle link stopper is provided with a first stop surface which is brought into engagement with the upper toggle link when the movable contact arm is being tripped open and a second stop surface which is brought into engagement with the upper toggle link at a position closer to the knee pin than to the first stop surface when the movable contact arm is bouncing back. Thus, the toggle link is engaged by two stop surfaces at two stages, enabling the preventing of the bouncing of the movable contact arm.

2 Claims, 6 Drawing Sheets

CIRCUIT INTERRUPTER WITH TWO STAGE STOPPER PREVENTING BOUNCE BACK

BACKGROUND OF THE INVENTION

This invention relates to a circuit interrupter and, more particularly, to a circuit interrupter in which the movable contact arm is prevented from bouncing during trip operation.

FIGS. 1 to 4 illustrate one example of a conventional circuit interrupter which has a contact arm stop arrangement similar to the circuit interrupter disclosed in Japanese Utility Model Laid-Open No. 52-11569. FIG. 1 is a sectional side view of the conventional circuit interrupter in the ON position, FIG. 2 is a partly cutaway side view of the circuit interrupter shown in FIG. 1 but in the OFF position, FIG. 3 is a view similar to FIG. 2 but illustrating the TRIP position with the movable contact arm separated, and FIG. 4 is a view similar to FIG. 2 but illustrating the TRIPPING position of the circuit interrupter in which the movable contact arm is being separated.

In these figures, the circuit interrupter comprises an electrically insulating housing 1 composed of a cover 1*a* and a base 1*b* on which a stationary contact 2*a* having secured thereon a stationary contact element 2*a* is fixedly mounted. A frame 3 is also firmly mounted to the base 1*b* by screws 4 (only one is shown). The frame 3 supports at its projection 3*a* an operating handle 5 so that the operating handle 5 is rotatable about the projection 3*a*. The operating handle 5 has mounted thereon a cradle 6 pivotable relative to the operating handle 5.

A toggle link 8, which includes an upper toggle link 8*a* and a lower toggle link 8*b* pivotally connected to the upper toggel link 8*a* by a knee pin 9, is connected to the operating handle 5 by an upper toggle link pin 7 at the upper end of the upper toggle link 8*a*. The lower end of the lower toggle link 8*b* is connected by a pin 12 to a cross bar 11 which is rotatably mounted by the base 1*b*. The knee pin 9 of the toggle link 8 is biased toward the operating handle 5 by a tension spring 10 connected between the pin 9 and the handle 5, thus maintaining the upper toggle link 8*a* in engagement with the projection 7. A movable contact arm 13 having a movable contact element 13*a* secured thereon is rotatably mounted on the cross bar 11 by a shaft 14. The movable contact arm 13 is electrically connected to a terminal conductor 15 through a flexible conductor 16.

The circuit interrupter also comprises an electromagnetic trip device including an electromagnetic device 17 which has a movable plunger 17*a*. A thermally responsive trip device having a bimetal 18 with an adjusting screw 18*a* is also provided. In order to pick up the movements of two kinds of trip devices, a trip bar 19 which is rotated by the screw 18*a* or the plunger 17*a* is provided. The trip bar 19 is in engagement with a latch 20 which is in engagement with a latch 21 which releasably latches the cradle 6.

The conventional circuit interrupter further comprises a toggle link stopper 23 pivotally mounted on the frame 3 by a pivot pin 28. The toggle link stopper 23 has a stop surface 23*a* at which the side edge of the upper toggle link 8*a* abuts during tripping of the circuit interrupter. The toggle link stopper 23 also has a surface 23*b* at which the stopper pin 22 secured on the frame 1 abuts in order to prevent the toggle link stopper 23 from being moved beyond a predetermined position.

When the circuit interrupter is in the ON position shown in FIG. 1, the current flows from the stationary contact 2 to the terminal conductor 15 through a stationary contact element 2*a*, the movable contact element 13*a*, the movable contact arm 13 and the flexible conductor 16. When the operating handle 5 is moved in the direction of an arrow 24, the upper end of the tension spring 10 is moved beyond dead center of the line of action of the spring 10, causing the tension spring 10 to collapse the toggle link 8 to move the movable contact arm 13 upwards together with the cross bar 11 until the operating mechanism takes the position shown in FIG. 2.

When a very large current flows through the circuit interrupter in the ON position shown in FIG. 1, the electromagnetic trip device is actuated to push out the plunger 17*a* from the electromagnetic device 17. Alternatively, when an overcurrent flows through the circuit interrupter in the ON position shown in FIG. 1, the thermally responsive trip device is actuated to push the trip bar 19 by the adjusting screw 18*a*. In either case, the trip bar 19 is rotated to rotate the latch member 20 and then the latch 21 rotates to release the cradle 6 under the action of the spring 10 which biases the cradle 6 to rotate clockwise. The cradle 6 is then rotated in the direction of an arrow 25 shown in FIG. 3 so that the toggle link pin 7 moves overcenter causing the toggle link 8 to collapse to rotate the movable contact arm 13 together with the cross bar 11 about the shaft 14 until they are brought into the TRIP position shown in FIG. 3 in which the movable contact element 13*a* is separated from the stationary contact element 2*a*.

When the movable contact arm 13 reaches the position beyond which further contact opening movement is prevented, the movable contact arm 13 bounces back toward its original position as shown by an arrow 26 in FIG. 3. However, the link stopper 23 which abuts at its stop surface 23*a* against the side edge of the upper toggle link 8*a* as shown in FIG. 4, prevents the further straightening of the toggle link 8 beyond the position shown in FIG. 4 thereby limiting the return movement of movable contact arm 13.

With the conventional stopper arrangement as above described, the stop surface 23*a* of the link stopper 23 engages the upper toggle link 8*a* only when the movable contact arm 13 is returning from the bouncing as shown in FIG. 4, and the stop surface does not engage the toggle link 8 during the contact trip-opening movement of the movable contact arm 13, providing only a relatively small stopping ability. Therefore, when the movable contact arm 13 is bounced with a greater force, the upper toggle link 8*a* of the toggle link 8 often cannot be stopped by the link stopper 23, allowing the movable contact element 13*a* to be brought back into contact with the stationary contact element 2*a*, resulting in a failure in current interruption.

SUMMARY OF THE INVENTION

Accordingly, an object of the present invention is to provide a circuit interrupter in which bouncing of the movable contact arm during tripping is significantly decreased.

Another object of the present invention is to provide a circuit interrupter in which the link stopper functions at two stages.

Another object of the present invention is to provide a circuit interrupter in which the link stopper provides a stop function not only while the movable contact arm is bouncing back but also while the movable contact arm is trip-opening.

With the above object in view, the circuit interrupter of the present invention comprises a toggle link having an upper toggle link and a lower toggle link pivotally connected by a knee pin to each other, a movable contact arm having a movable contact element secured thereon and connected to the lower toggle link of the toggle link, and a toggle link stopper capable of contacting the upper toggle link for preventing the bouncing back of the movable contact arm during tripping of the movable contact arm. The toggle link stopper is provided with a first stop surface which is brought into engagement with the upper toggle link when the movable contact arm is being tripped open and a second stop surface which is brought into engagement with the upper toggle link at a position closer to the knee pin than to the first stop surface when the movable contact arm is bouncing back.

According to the present invention, the toggle link stopper is provided with a first stop surface which is brought into engagement with the upper toggle link when the movable contact arm is being tripped open, and a second stop surface which is brought into engagement with the upper toggle link when the movable contact arm is bouncing back from the trip position. Therefore, the toggle link is engaged by two stop surfaces at two stages, enabling the prevention of the bouncing of the movable contact arm.

BRIEF DESCRIPTION OF THE DRAWINGS

The present invention will become more readily apparent from the following detailed description of the preferred embodiment of the present invention taken in conjunction with the accompanying drawings, in which.

The same reference numerals designate identical or corresponding components throughout the drawings.

DESCRIPTION OF THE PREFERRED EMBODIMENT

Figure 1:
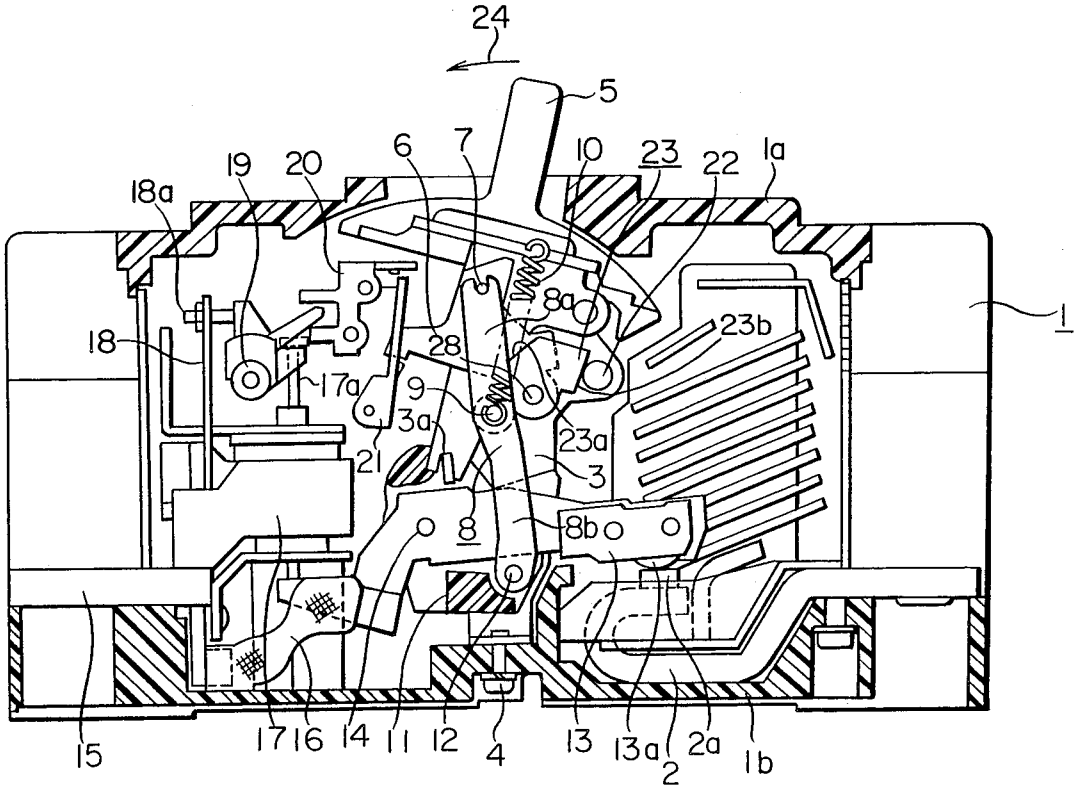
FIG. 1 PRIOR ART
FIG. 1 is a sectional side view of the conventional circuit interrupter in the ON position.
Figure 2:
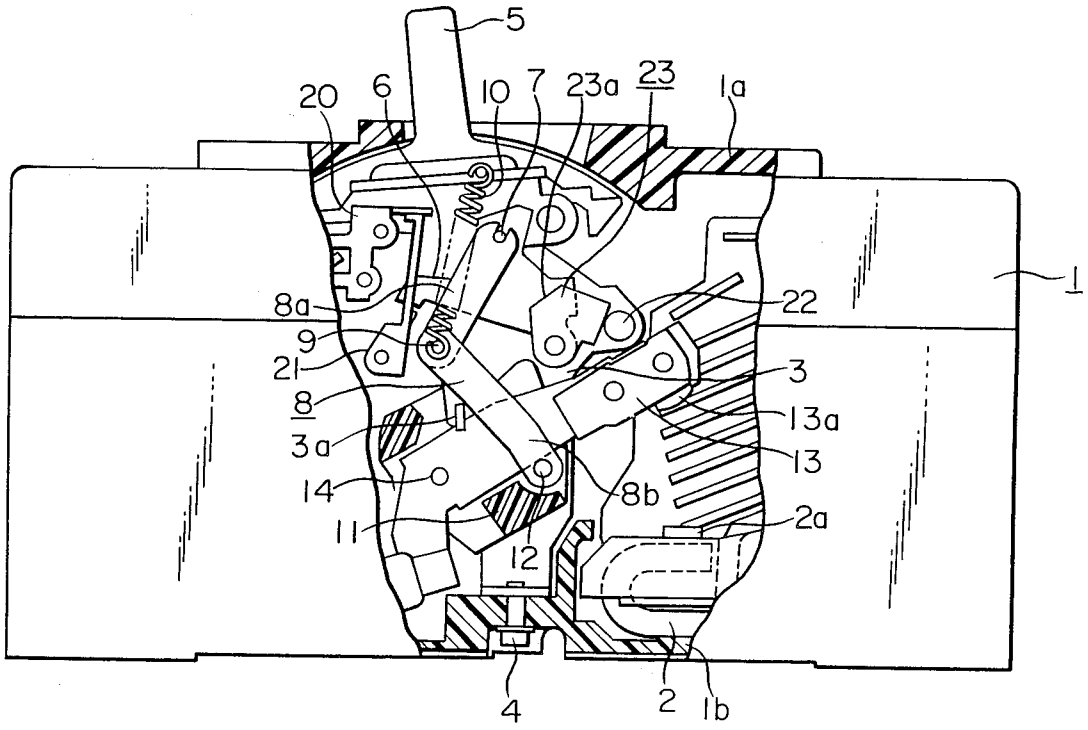
FIG. 2 PRIOR ART
FIG. 2 is a partly cut-away side view of the circuit interrupter shown in FIG. 1 but in the OFF position.
Figure 3:
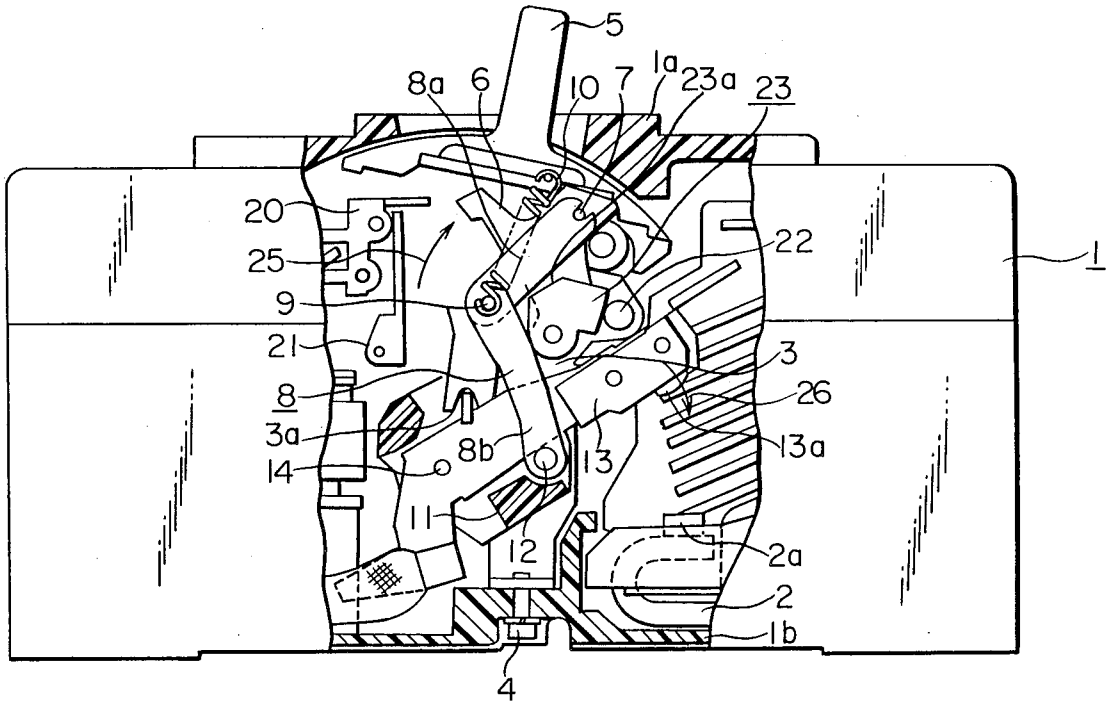
FIG. 3 PRIOR ART
FIG. 3 is a view similar to FIG. 2 but illustrating the TRIP position with the movable contact arm separated.
Figure 4:
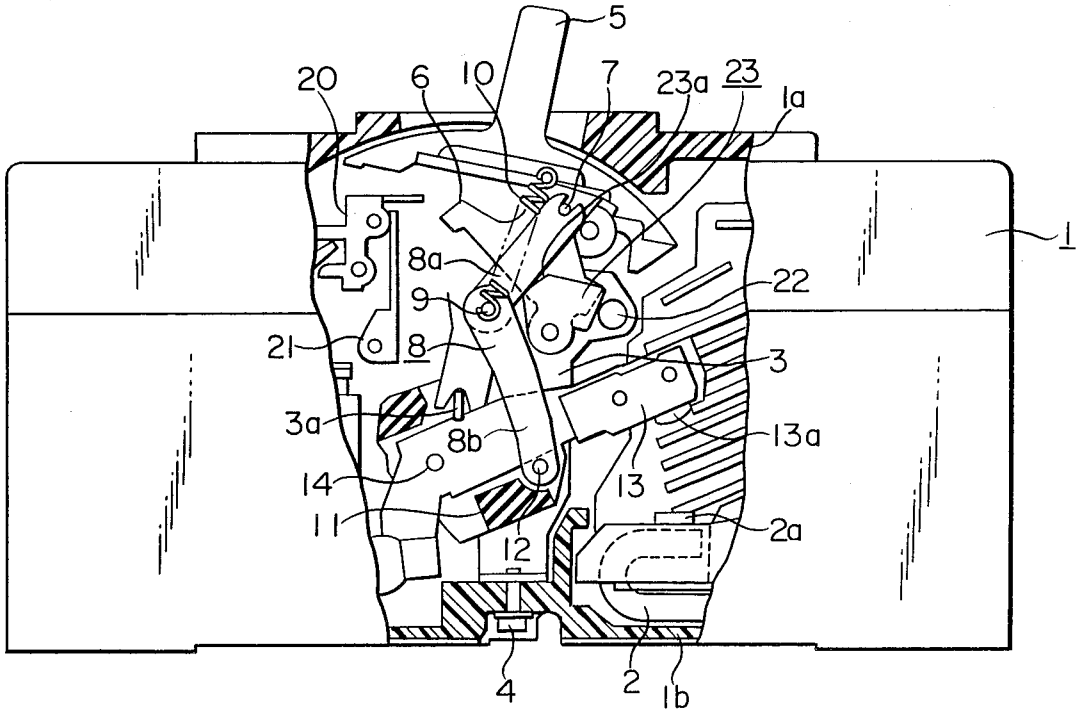
FIG. 4 PRIOR ART
FIG. 4 is a view similar to FIG. 2 but illustrating the position of the circuit interrupter during TRIPPING in which the movable contact arm is being separated.
Figure 5:
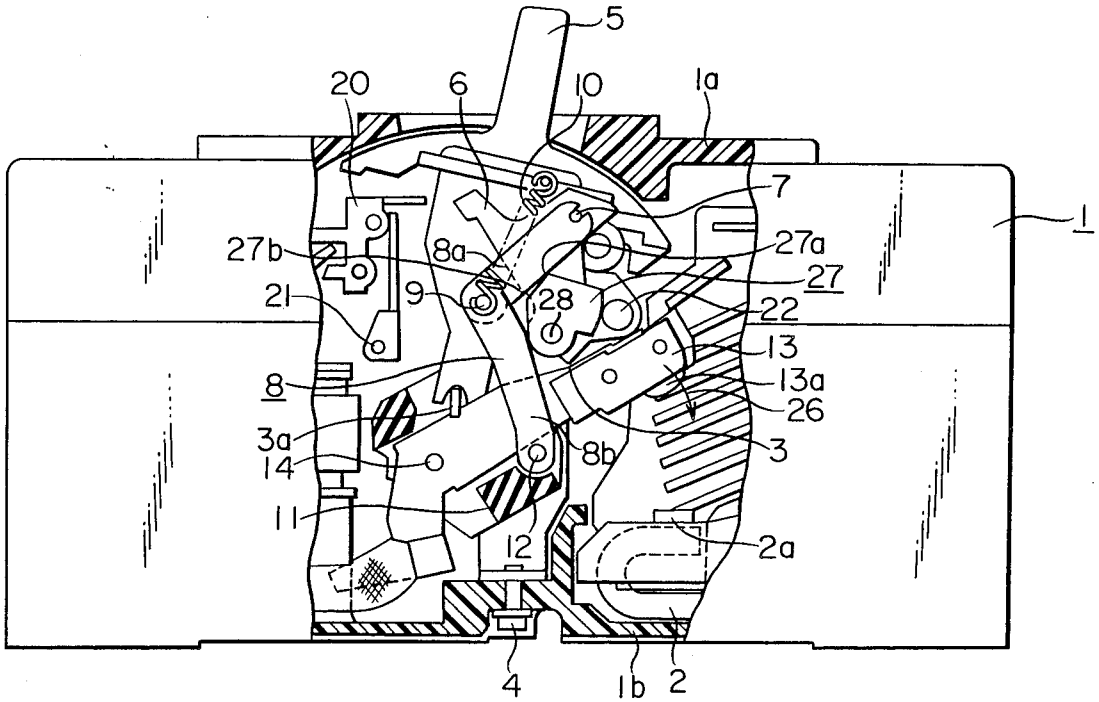
FIG. 5 is a partly cut-away side view of the circuit interrupter of the present invention in a position in which the movable contact arm is being trip-opened.
Figure 6:
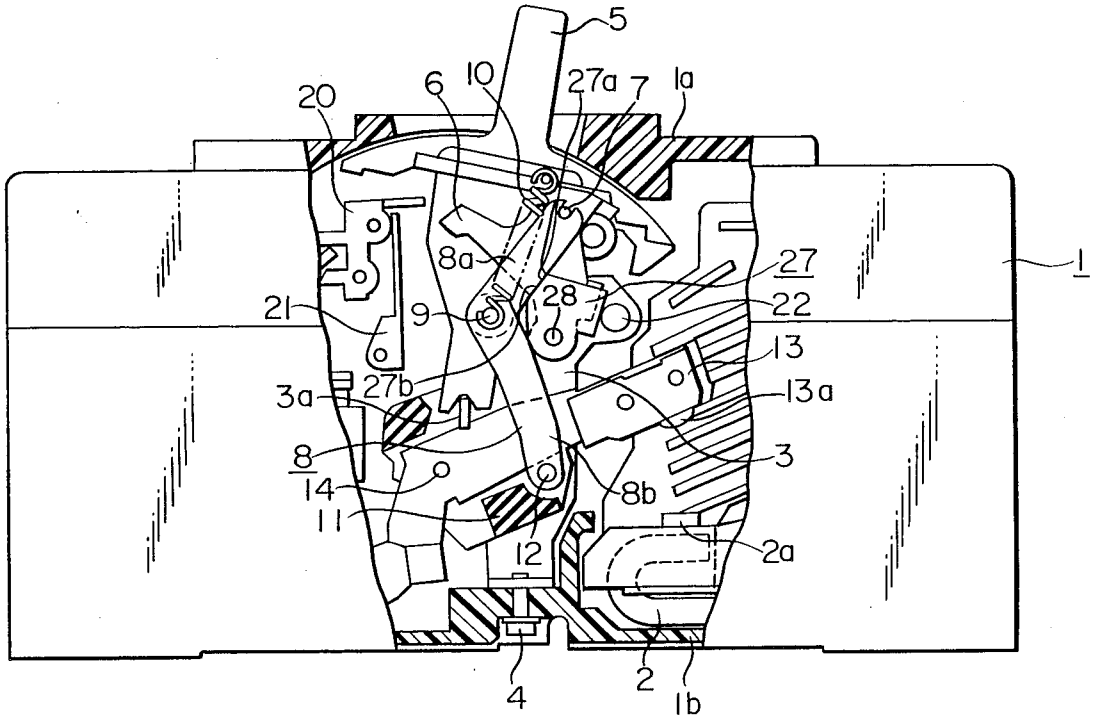
FIG. 6 is a view similar to FIG. 5 but illustrating the movable contact arm bouncing back after being tripped.

FIGS. 5 and 6 show the movable contact arm and the toggle link of the circuit interrupter of the present invention being trip-opened, and bouncing back after being tripped, respectively. The circuit interrupter of the present invention has a structure identical to that of the conventional design shown in FIGS. 1 to 4 except for construction of the toggle link stopper 27.

The toggle link stopper 27 is rotatably supported on the frame 3 by a pivot pin 28, but its pivotting movement is limited by a stopper pin 22 within a predetermined range. The toggle link stopper 27 has a first stop surface 27*a*, a second stop surface 27*b*. The first stop surface 27*a* is arranged to be brought into engagement with the side edge of the upper toggle link 8*a* when the operating mechanism and therefore the movable contact arm 13 is being tripped open. The second stop surface 27*b* is arranged to be brought into engagement with the side edge of the upper toggle link 8*a* when the movable contact arm 13 is bouncing back from the trip position.

When the circuit interrupter is trip-opened by the trip mechanism of the circuit interrupter, the toggle link 8 collapses to move the movable contact arm 13 in the opening direction. Immediately before the movable contact arm 13 reaches its final open position, the righthand side (in FIG. 5) of the upper toggle link 8*a* hits against the first stop surface 27*a* of the toggle link stopper 27. Since the clockwise rotation of toggle link stopper 27 about the pin 28 is prevented by the stopper pin 22, a further righthand (in FIG. 5) movement of the upper toggle link 8*a* is prevented and a further opening movement of the movable contact arm 13 is prevented. As is well known in the art, after the movable contact arm 13 reaches its final open position, the movable contact arm 13 bounces and tends to return to the original closed position. During this bounce back, the toggle link 8 is moved in the direction to where it is straightened. This straightening movement of the toggle link 8 causes the upper toggle link 8*a* to rotate counterclockwise and the second stop surface 27*b* of the toggle link stopper 27 engages the side edge of the upper toggle link 8*a* at a position closer than that of the first stop surface 27*a* relative to the knee pin 9. Since the toggle link stopper 27 is also at this time prevented from being rotated by the upper toggle link 8*a* by the stop pin 22, the upper toggle link 8*a* is stopped at the position illustrated in FIG. 6.

In the embodiment illustrated in FIG. 6, the second stop surface 27*b* is a surface continuous from the first stop surface 27*a*, the upper toggle link 8*a* can not only be stopped but also held at the position illustrated in FIG. 6 due to the friction between the upper toggle link 8*a* and the toggle link stopper 27.

It is to be noted that the greater the distance between the remote ends (corners in the illustrated embodiment) of the first and the second stop surfaces 27*a* and 27*b*, the more effective the toggle link stopper 27. This is because the force on the upper toggle link 8*a* which acts to rotate it counterclockwise about the remote end of the second stop surface 27*b* becomes smaller as the remote end of the second stop surface become closer to the knee pin 9 of the toggle link 8.

Thus, the upper toggle link 8*a* of the toggle link 8 is engaged by two stop surfaces 27*a* and 27*b* at two stages, during trip opening and during bouncing, enabling the prevention of the bouncing of the movable contact arm 13 toward the contact closed position.

What is claimed is:

1. A circuit interrupter comprising:

a toggle link having an upper toggle link and a lower toggle link pivotally connected by a knee pin to each other;

a movable contact arm having a movable contact element secured thereon and connected to said lower toggle link of said toggle link; and a toggle link stopper contacting said upper toggle link and limiting bouncing back of said movable contact arm during tripping of said movable contact arm;

said toggle link stopper having a first stop surface which is brought into engagement with said upper toggle link when said movable contact arm is being tripped open and a second stop surface which is brought into engagement with said upper toggle link at a position closer to said knee pin than to said first stop surface when said movable contact arm is bouncing back.

2. A circuit interrupter as claimed in claim 1, wherein said first stop surface and said second stop surface are defined by two corners of said toggle link stopper and share a continuous side with each other.

* * * * *